United States Patent [19]

Helesfai

[11] 4,226,013

[45] Oct. 7, 1980

[54] TOOL KIT FOR ATTACHING AND REMOVING SPIRAL LOCK WASHERS

[75] Inventor: Steven Helesfai, Nicholasville, Ky.

[73] Assignees: Harry C. Miller; Georgia R. Miller, both of Merritt Island, Fla.

[21] Appl. No.: 26,952

[22] Filed: Apr. 4, 1979

[51] Int. Cl.[3] ..... A44B 13/02

[52] U.S. Cl. ..... 29/235; 29/243.52; 7/170

[58] Field of Search ..... 7/166, 170; 29/235, 29/243.52, 267, 280

[56] References Cited

U.S. PATENT DOCUMENTS

| | | | |
|---|---|---|---|
| 2,968,864 | 1/1961 | Lee | 29/235 |
| 3,145,463 | 8/1964 | Hockett | 29/235 X |
| 3,319,325 | 5/1967 | Nessamar et al. | 29/235 |
| 3,978,573 | 9/1976 | Williams | 29/267 |

FOREIGN PATENT DOCUMENTS

| | | | |
|---|---|---|---|
| 612617 | 1/1961 | Canada | 29/235 |

*Primary Examiner*—James G. Smith

*Attorney, Agent, or Firm*—Mason, Fenwick & Lawrence

[57] ABSTRACT

A kit for permitting the mounting and removal of spiral lock washers to and from an annular washer retaining groove on a tumbler wheel post of a combination lock or the like includes a cylindrical tubular container-tool with an internal chamber for storing a washer removing tool and a washer guide stub. The guide stub is fittable in an axial opening in an end of the tumbler wheel post so that such a spiral lock washer positioned on a conical downwardly and outwardly flairing surface of the stub can be moved into the washer retaining groove by positioning the open end of the container-tool over the washer and then forcing the washer downwardly along the guide stub into the retaining groove; the washer removing tool has a cylindrical body having one end insertable in the axial opening in the post with a spring urged pivot arm mounted in the body having an outer end adjacent the body for movement between the flights of a washer in the washer retaining groove so that subsequent rotation of the body effects movement of the washer from the groove upwardly and outwardly of the post.

20 Claims, 12 Drawing Figures

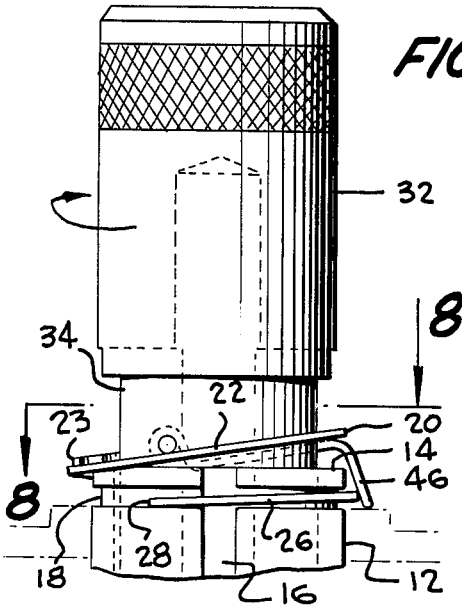
FIG-7
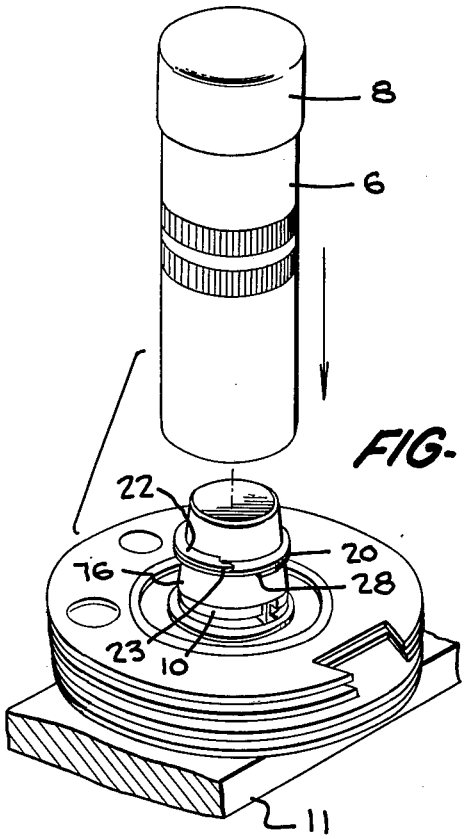
FIG-9
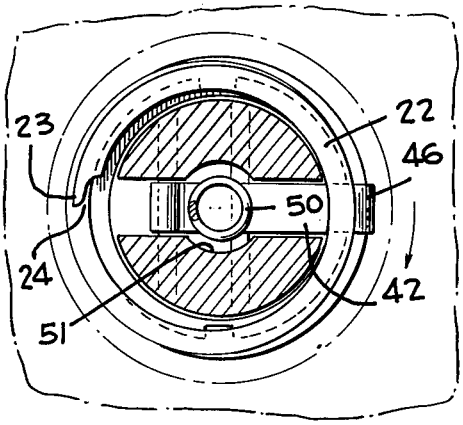
FIG-8
FIG-10
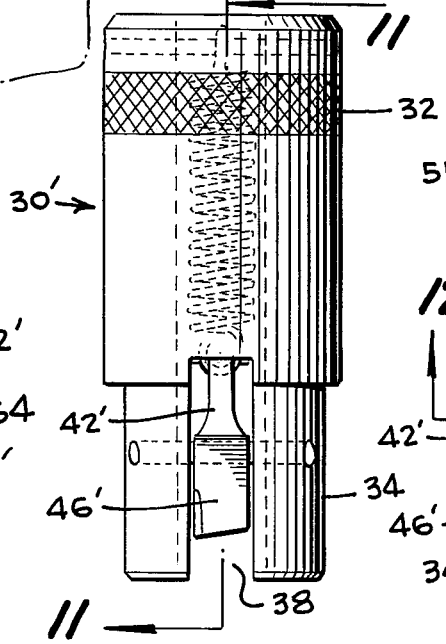
FIG-11
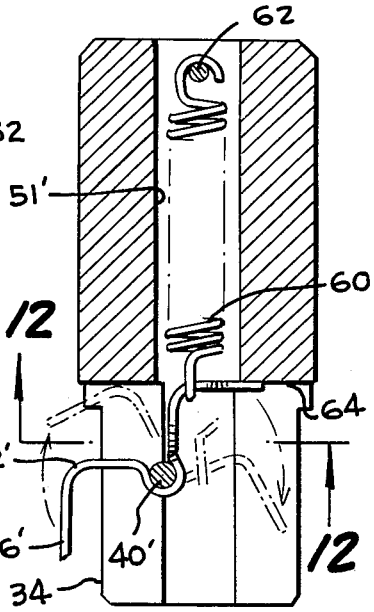
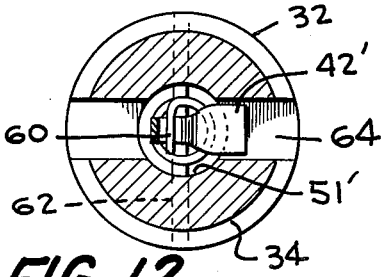
FIG-12

TOOL KIT FOR ATTACHING AND REMOVING SPIRAL LOCK WASHERS

BACKGROUND AND OBJECTS OF THE INVENTION

The subject invention is directed to the general field of tools usable in connection with tumbler wheel lock mechanisms of the type generally found in combination locks. More specifically, the subject invention is directed to a kit including hand tool means for effecting both the speedy and efficient removal of a spiral lock washer from a tumbler wheel post and the positioning of such a washer on the post.

Combination locks employ three or more tumbler wheels which are loosely mounted in coaxial side-by-side parallel spaced relation with respect to each other for rotation on a tubular arbor or tumbler wheel post projecting in a cantilever manner from a supporting member such as a housing, frame plate or the like. Normally, the outer or free end of the tumbler wheel post has a peripheral annular groove inwardly spaced a short distance from the outer end of the post and in which a spiral washer is positioned for maintaining the tumbler wheels on the post. Additionally, the post is provided with diametrically opposed axially parallel slots extending longitudinally inwardly from the outer end of the post members.

The spiral lock washers are normally in the form of two spiral flats consisting of an upper flat and a lower flat which are positioned in the annular groove on the tumbler wheel post with the ends of the spiral members forming the lock washer providing a notch between the washer ends and the side of the post. The washers are of substantial strength and are difficult, if not impossible, to remove them from or position them on the post manually. Moreover, no specialized tools are available for removing or positioning the washers and persons in the art have consequently had to rely upon standard hand tools in performing these functions with the results being less than satisfactory.

Thus, it is the primary object of this invention to provide a new and improved means for removing a spiral lock washer from the annular groove in a tumbler wheel post.

A further object of this invention is to provide a new and improved means for positioning a spiral lock washer in an annular groove in a supporting post.

Yet another object of the invention is the provision of a new and improved kit for permitting the positioning of a spiral lock washer in an annular washer retaining groove on a supporting post and for permitting the removal of a spiral lock washer from such a groove.

Other desirable objects, advantages and results of the invention will become apparent from the following detailed description, taken in conjunction with the accompanying drawings, which illustrate preferred embodiments of the invention.

Achievement of the objects of this invention is enabled by the preferred embodiment which comprises a kit including a tubular container-tool having a hollow cylindrical interior with a diameter slightly in excess of the diameter of the tumbler wheel post with which the kit is to be used. A removable cap is provided for the open end of the container to retain the other components of the kit in the container during periods of non-use. The kit further includes a washer removing hand tool consisting of a cylindrically shaped body member having a lower or guide end dimensioned to be matingly insertable in the socket opening normally provided in the outer or free end of a tumbler wheel post. The body member has an internally positioned pivot rod extending chordally with respect to the body member and which provides pivotal support for a pivot lever or arm mounted on the pivot rod and extending transversely within the interior of the body member. The pivot lever has approximately perpendicular inner and outer arm portions with the outer arm portion extending parallel to the axis of the cylindrical body member downwardly along the guide end of the body member. Spring means is provided inside the body member for biasing the pivot arm to a rest position in which the parts are oriented as described above. The rest position is determined by abutment means provided on the interior of the cylindrical body member to be engaged by the pivot arm. The pivot arm is formed of thin steel stock having its thickness dimension oriented substantially parallel to the direction of pivotal movement of the pivot arm member. The outer end portion of the pivot arm is relatively thin and when the lower or guide end of the cylindrical body member is inserted in the opening in the post, the outer end, which comprises a lift finger, is movable into a relatively narrow slot defined by a bevel surface provided in the extreme end of the upper flight of the spiral washer member positioned in the annular groove of the supporting post. When the lift finger is positioned in the aforementioned slot, the body member is then rotated about its axis to cause the finger member to move between the upper spiral flight and the lower spiral flight of the spiral lock washer to separate the flights. The washer does not rotate and continued rotation of the cylindrical body member causes the lifter finger to traverse the entire length of space between the two flights of the spiral washer until such time as it clears the end of the lower flight to effectively position the entire washer above the lift finger and to permit movement of the washer outwardly along the outer surface of the cylindrical body member until it is completely removed from the annular groove and the supporting post. In one embodiment of the invention, a compression spring is used for biasing the pivot arm or lever into its rest position while in a second embodiment, a tension spring is used for the same purpose.

Positioning of a washer in the annular groove is effected by a washer guide stub having an upper end with a conical downwardly flaring surface over which a spiral lock washer can be fitted with a male guide shaft at the lower end of the guide stub being matingly insertable in the axial opening in the upper end of the post. The open end of the tubular container-tool is then positioned over the washer on the conical surface and moved downwardly to force the washer from the conical surface downwardly into the annular groove of the post.

A better understanding of the manner in which the preferred embodiments of the invention achieve the object of the invention will be enabled when the following detailed description is considered in conjunction with the appended drawings in which like reference numerals are used throughout the different figures for designating the same parts.

BRIEF DESCRIPTION OF THE FIGURES

FIG. 7 is an elevational view illustrating the components in a position subsequent to the position of FIG. 6;

FIG. 8 is a sectional view taken along lines 8—8 of FIG. 7;

FIG. 9 is a perspective view illustrating the manner of operation of the invention for positioning a spiral lock washer on a tumbler wheel support post;

FIG. 10 is an elevational view of a second embodiment of a hand tool for use in removing a spiral lock washer from a tumbler wheel supporting post;

FIG. 11 is a sectional view taken along lines 11—11 of FIG. 10; and

FIG. 12 is a sectional view taken along lines 12—12 of FIG. 11.

DESCRIPTION OF PREFERRED EMBODIMENTS

Figure 2:
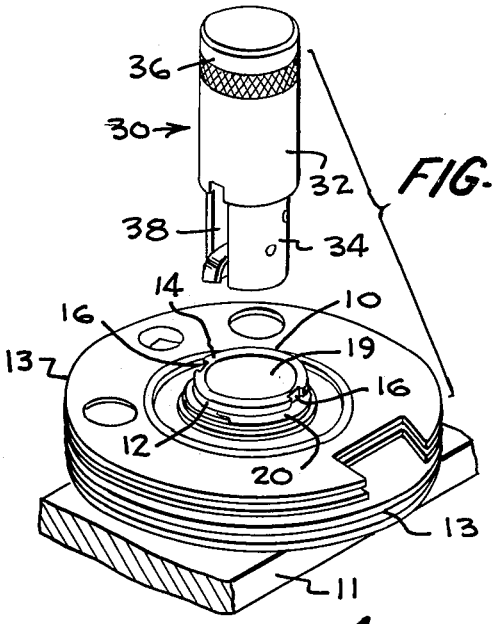
FIG. 2 is a perspective view illustrating a hand tool component of the invention in conjunction with a tumbler wheel post assembly with which the hand tool is used for removing a spiral lock washer therefrom.
Figure 5:
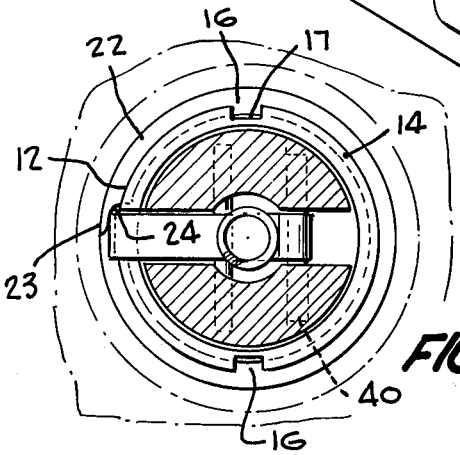
FIG. 5 is a sectional view taken along lines 5—5 of FIG. 4.

FIG. 2 illustrates a typical tumbler wheel and post mechanism of a combination lock with which the present invention is particularly designed to be used and which consists of a support member 10 in the form of a tumbler wheel post 10 extending from a lock case portion 11 which is typically the front wall or rear cover of the lock case. The tumbler wheel post 10, here shown for convenience as vertically oriented, comprises a tubular arbor having a cylindrical outer surface 12 on which tumbler wheels 13 are supported for rotation in a well-known manner. The support post 10 also has a cylindrical axial opening 19 which is provided in an upper end surface 14. Additionally, a pair of relatively deep longitudinal slots 16 are provided on opposite sides of the post with the slots 16 being oriented parallel to the axis of the support member and having a bottom surface 17. An annular washer retaining groove 18 (FIG. 4) of less radial depth than the depth of the longitudinal slots 16 is positioned inwardly of the upper end surface 14 of the post member. A spiral lock washer 20 is mounted in the annular washer retaining groove 18 and includes an upper flight 22 having an upper flight end termination provided by a notched or inclined ramp-like end surface 23 which defines a slot 24 between the upper flight end 23 and the surface 12 of the cylindrical post member 10 as best shown in FIG. 5. Additionally, the spiral lock washer 20 includes a lower flight 26 having an end termination 28. It should be understood that the foregoing construction is completely conventional and the present invention is directed to a kit means for both permitting the positioning of the washer 20 in annular washer retaining groove 18 and for permitting the removal of the washer from the groove.

The three basic components of the invention comprise a metal tubular container-tool 6, a hand tool 30 and a washer guide stub 70. The tubular container tool 6 has a cylindrical inner chamber 7 of sufficient diameter and length to permit the storage of hand tool 30 and washer guide stub 70 therein with the chamber being closed at its ends by removable plastic caps 8.

Figure 1:
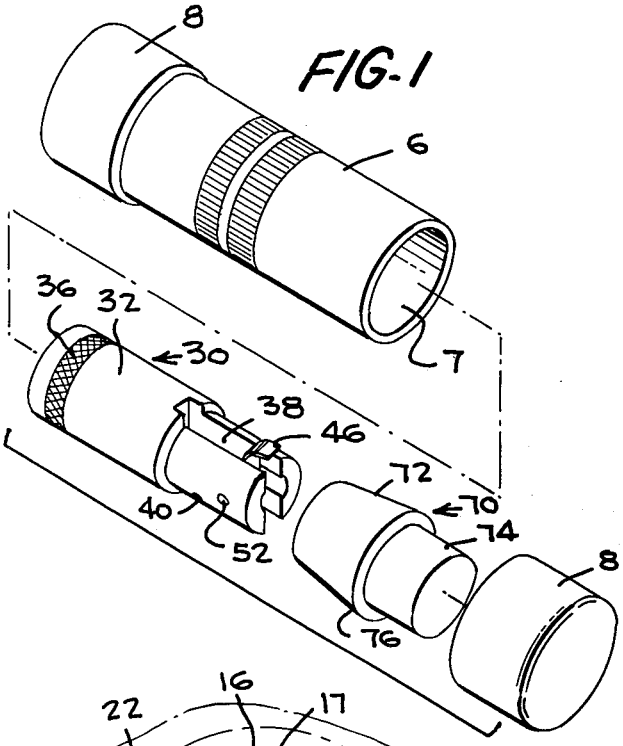
FIG. 1 is an exploded perspective view of the components forming the preferred embodiment of the invention.

The embodiment of the hand tool 30 illustrated in FIG. 1 has an elongated body member formed of aluminum or the like and having a relatively large upper or handle portion 32 having a knurled surface portion and a smaller diameter lower or guide portion 34. The handle or upper portion 32 is knurled as shown at 36 and the lower or guide portion 34 is provided with a diametrically positioned slot 38 across which a pivot pin rod 40 is mounted. A pivot arm 42 formed of relatively thin steel stock is pivotally mounted on the pivot pin rod 40. The pivot arm 42 includes an inner arm portion 44 and an outer arm or lift finger portion 46 with the inner and outer arm portions being approximately perpendicular to each other. Additionally, it should be noted that the outer arm portion is positioned externally of the cylindrical body member and extends downwardly along the side of the guide portion 34.

Figure 4:
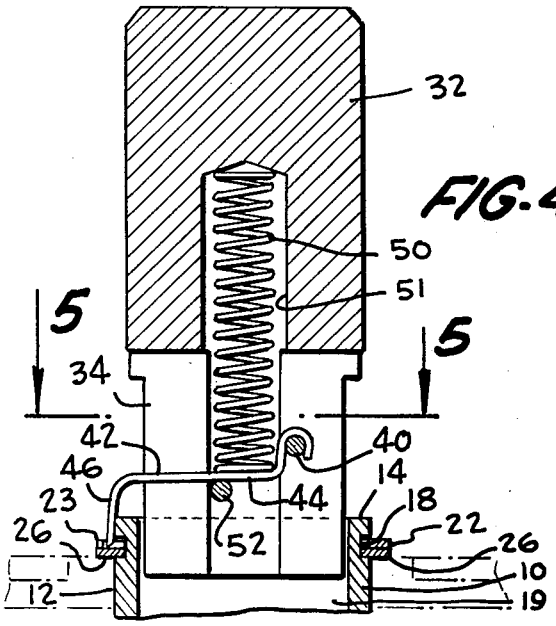
FIG. 4 is a sectional view taken along lines 4—4 of FIG. 3.

Pivot arm 42 is maintained in the illustrated position of FIG. 4 by operation of compression spring 50 having one end engaging the upper surface of the pivot arm and having its opposite end engaging a fixed abutment surface defined by the inner end of an axial bore 51 in the cylindrical body member. Spring 50 urges the arm against a fixed abutment or stop rod 52. It should be observed that the pivotal movement of the pivot arm 42 is in a plane perpendicular to the axis of the pivot pin rod 40 with the thickness dimension of the pivot arm being oriented in the pivot plane.

Figure 3:
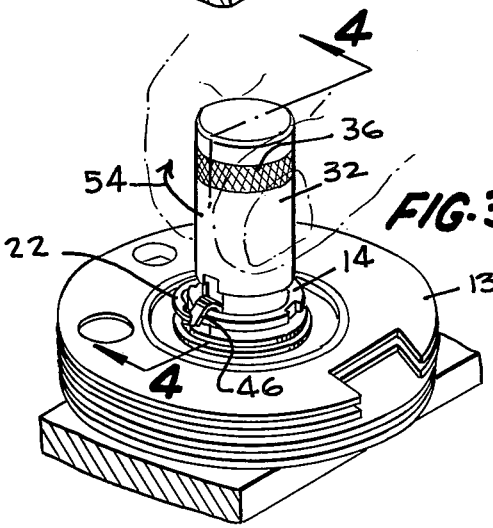
FIG. 3 is similar to FIG. 2 but illustrates the hand tool in an initial position of operation for effecting removal of the washer.
Figure 6:
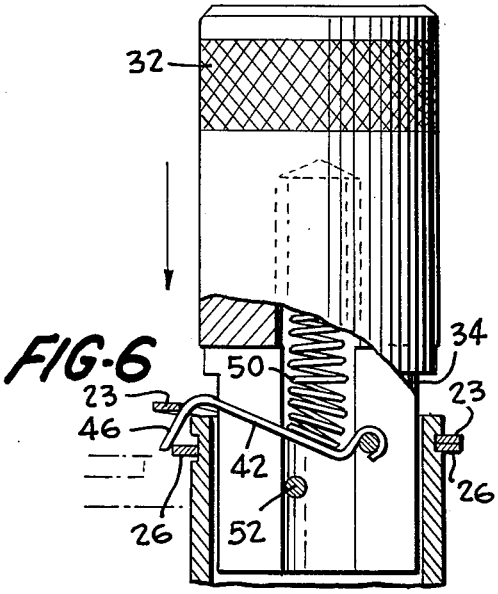
FIG. 6 is a partial sectional view similar to FIG. 5 but illustrating the parts in a different subsequent position of orientation during the washer removal process.

When the guide end 34 of the cylindrical body member is positioned in the axial opening 19 in the upper end of the tumbler wheel post 10 as shown in FIG. 4 and is moved forwardly until the lift finger 42 is positioned with its lower end edge against the upper surface of the lower flight 26, it will be observed that the lower end of the lift finger is positioned in the slot 24 defined by the notched end portion 23 and the outer surface of the cylindrical body member. Subsequent rotation of the cylindrical body member as illustrated by arrow 54 in FIG. 3 causes the lift finger to move between the upper and lower spiral flights of the spiral lock washer as shown in FIGS. 6 and 7 to effect separation of the flights with the continued rotation of the body member and, in effect, "peel" the spiral lock washer portions engaged by the lift finger 42 out of the groove 18, eventually causing the lift finger to clear the end 28 of the lower flight at which time the washer is completely removed from the annular slot or groove 18.

FIGS. 10 through 12 illustrate a second embodiment 30′ of the invention which is essentially identical in operation to the fitst embodiment. The only difference in the second embodiment from the first embodiment is that it employs a differently shaped pivot arm 42′ mounted on a pivot rod 40′ and a tension spring 60 hooked over a rod 62 in the upper end of a bore 51′ in the cylindrical body member for biasing one end of the pivot arm against an abutment surface 64 shown in FIG. 11.

Also, it will be observed that the positioning of the pivot pin 40′ in the second embodiment is different from that of the pivot pin 40 of the first embodiment. However, the operation of the spring 60 tends to move the outer end 46' of the pivot arm to the same rest position as that of the end 46 of the first embodiment. Operation of the second embodiment device is consequently identical to that of the first embodiment. Either the first or second embodiment provides a uniquely simple and easy to use device capable of quickly removing spiral lock washers from the annular grooves provided in the arbor post 10.

The mounting of a lock washer in the annular groove or slot 18 is effected by use of the container-tool 6 and a guide stub 70 provided for guiding the washer 20 onto the upper end of the support member 10 to effect positioning of the washer in the annular washer retaining groove 18. The washer guide stub 70 includes a generally conical downwardly flaring surface 72 over which a spiral lock washer 20 can be fitted. Additionally, the washer guide stub 70 includes positioning means comprising a male guide stub shaft member 74 matingly insertable in the cylindrical opening 19 in the upper end of support member 10. Consequently, accurate axially aligned positioning of the guide stub 70 on the upper end surface 14 of the support member 10 is effected so that the periphery of the lower large diameter end 76 of the conical surface 72 is in substantial alignment with the cylindrical outer surface 12 of the support member 10 as shown in FIG. 8.

The positioning of the guide stub on the upper end of a support member 10 is followed by the positioning of a spiral lock washer 20 on the guide stub encircling the surface 72 as shown in solid lines in FIG. 8. The container-tool 6 is then positioned above the washer on the guide stub and is moved downwardly to force the washer from the lower or large diameter end portion 76 onto the cylindrical surface 12 while progressively expanding the washer diameter as it moves along the surface 72 of the guide stub 70 and into the annular washer retaining groove 18.

Numerous modifications of the disclosed embodiments will undoubtedly occur to those of skill in the art and it should be understood that the spirit and scope of the invention is to be limited solely by the appended claims.

I claim:

1. A tool for removing a spiral lock washer having upper and lower spiral flights from an annular washer retaining groove adjacent a free end of a supporting member having an axial opening in said free end and also having a cylindrical outer surface, said tool comprising an elongated body member having a guide end and a handle end, pivot means mounted in one end of said elongated body member extending transversely with respect thereto, a pivot lever mounted on said pivot means, said guide end of said elongated body member being dimensioned and shaped so as to be matingly insertable in said axial opening, a lift finger on an outer end of said pivot lever having an outer end tip positioned externally adjacent the guide end to be positionable in a space between the end tip of the upper spiral of the spiral lock washer positioned in an annular washer retaining groove of a supporting member when said guide end is inserted a predetermined distance in the associated axial opening of the supporting member whereby movement of said guide end inwardly of said axial opening beyond said predetermined distance effects pivotal movement of the lift finger to cause the end of the upper spiral to be lifted outwardly of the annular washer retaining groove to ride up on the lift finger to result in the positioning of the lift finger between the upper spiral flight and the lower spiral flight whereby subsequent rotation of the elongated body member about its longitudinal axis effects traversal of the lift finger along the entire length of space between the upper and lower spiral flights to a position below the lower flight to cause the spiral washer to be peeled off of the supporting member and completely removed from the annular groove and displaced outwardly of the free end of the supporting member.

2. The invention of claim 1 additionally including stop means mounted in said body member, biasing means for urging said pivot lever into engagement with said stop means in a stop position closely adjacent said guide end of said body member.

3. The invention of claim 2 wherein said biasing means comprises a compression spring.

4. The invention of claim 2 wherein said biasing means comprises a tension spring.

5. The invention of claim 2 wherein said pivot means comprises a pivot rod oriented transversely of, and on the interior of, said elongated body.

6. A hand tool comprising an elongated generally cylindrical body member having an upper end and a lower end, pivot means on the interior of said body member, a pivot arm carried by said pivot means for pivotal movement in a plane of movement about a pivot axis transverse to said cylindrical body member, said pivot arm having an outer arm portion external of said body member and an inner arm portion generally transverse to the cylindrical body member and oriented substantially perpendicular to said outer arm portion and substantially on the interior of said body member, stop means on said body member and biasing means urging said pivot arm into a normal position engaging said stop means in which position the outer arm portion is closely adjacent and outwardly of the outer surface of, and substantially parallel to the longitudinal axis of, said body member.

7. The invention of claim 6 wherein said biasing means comprises a compression spring.

8. The invention of claim 6 wherein said biasing means comprises a tension spring.

9. The invention of claim 6 wherein said pivot arm is formed of thin spring steel stock.

10. The invention of claim 6 wherein said pivot means comprises a pivot rod oriented chordally with respect to said cylindrical body member, said stop means comprising a stop rod mounted a distance below said pivot rod and transversely spaced from a vertical plane passing through the longitudinal axis of said pivot rod, wherein said biasing means comprises a compression spring extending between a spring stop in said body member and an upper surface of said pivot arm and said outer arm portion is formed of relatively thin material extending generally downwardly away from said inner arm portion and having its thickness dimension parallel to the plane of movement of said pivot arm.

11. The invention of claim 6 wherein said pivot means comprises a pivot rod oriented chordally in and with respect to said cylindrical body member, said stop means comprising an abutment surface transversely oriented in said body member above, but not in vertical alignment with, said pivot rod, said biasing means comprise a tension spring extending between a fixed spring support rod and said pivot arm for urging the inner arm portion into engagement with said abutment surface and wherein said pivot arm is formed of thin steel stock having its thickness dimension parallel to the plane of movement of said pivot arm.

12. The invention of claim 6 wherein said pivot means comprises a pivot rod oriented transversely of, and on the interior of, said body member.

13. The invention of claim 12 wherein said biasing means comprises a compression spring.

14. The invention of claim 12 wherein said biasing means comprises a tension spring.

15. A kit for permitting the removal of a spiral lock washer having upper and lower spiral flights from an annular washer retaining groove adjacent a free end of a cylindrical support member having an axial opening in said free end and also having a cylindrical outer surface or for permitting the mounting of such a washer on such a supporting member, said kit including a washer removing tool comprising an elongated body member having a guide end and a handle end, pivot means mounted in one end of said elongated body member extending transversely with respect thereto, a pivot lever mounted on said pivot means, said guide end of said elongated body member being dimensioned and shaped so as to be matingly insertable in said axial opening, a lift finger on an outer end of said pivot lever having an outer end tip positioned externally adjacent the guide end to be positionable in a space between the end tip of the upper spiral of a spiral lock washer positioned in an annular washer retaining groove of a supporting member when said guide end is inserted a predetermined distance in the associated axial opening of the supporting member whereby movement of said guide end inwardly of said axial opening beyond said predetermined distance effects pivotal movement of the lift finger between the upper spiral flight and the lower spiral flight whereby subsequent rotation of the elongated body member about its longitudinal axis effects traversal of the lift finger along the entire length of space between the upper and lower spiral flights to a position below the lower flight to cause the spiral washer to be completely removed from the annular groove and displaced outwardly of the free end of the supporting member, washer mounting means including a washer guide stub having a conical side surface defining a large diameter end and a small diameter end of said washer guide stub, positioning means adjacent the large diameter end of said washer guide stub for holding the washer guide stub in position on the upper end of said cylindrical support member so that the cylindrical side surface of the cylindrical support member is substantially aligned with the conical side surface at the large diameter end of said washer guide stub and a container kit comprising a hollow tubular member having an open end with a diameter slightly exceeding the diameter of the outer surface of the cylindrical support member, said hollow tubular member being of different length to store said washer removing tool and said washer guide stub on its interior and removable cap means positionable over said open end for retaining said washer guide stub and said washer removing tool in said container-tool, whereby a spiral lock washer placed on the lock washer guide stub can be forcefully moved in an axial direction thereon by said container-tool when the open end of the container-tool is fitted over the guide stub to effect movement of the spiral lock washer along the stub past the large diameter end thereof to snap the washer in position in the annular retaining groove.

16. The invention of claim 15 wherein said positioning means comprises an axially extending stub shaft extending from adjacent the large diameter end of the washer guide stub and having an outer surface matingly received in a recessed socket opening in the end of said support member.

17. The invention of claim 16 additionally including stop means mounted in said body member, biasing means for urging said pivot lever into engagement with said stop means in a stop position closely adjacent said guide end of said body member.

18. The invention of claim 17 wherein said biasing means comprises a compression spring.

19. The invention of claim 17 wherein said biasing means comprises a tension spring.

20. The invention of claim 17 wherein said pivot means comprises a pivot rod oriented transversely of, and on the interior of, said elongated body.

* * * * *